US006251225B1

(12) United States Patent
Ruf et al.

(10) Patent No.: US 6,251,225 B1
(45) Date of Patent: Jun. 26, 2001

(54) PROCESS FOR REGULATING THE BREAKING LENGTH RATIO OF A MANUFACTURED PAPER WEB

(75) Inventors: Wolfgang Ruf, Herbrechtingen (DE); Otto L. Heissenberger, Pottenbrunn (AT)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/503,203

(22) Filed: Feb. 14, 2000

(30) Foreign Application Priority Data

Mar. 2, 1999 (DE) ..... 199 08 973

(51) Int. Cl.[7] ..... D21F 11/00

(52) U.S. Cl. ..... 162/198; 162/DIG. 10; 162/DIG. 11; 162/252; 162/208; 162/254; 162/336; 703/143

(58) Field of Search ..... 162/198, DIG. 10, 162/252, 208, DIG. 11, 254, 336; 702/143

(56) References Cited

U.S. PATENT DOCUMENTS 4,133,713 1/1979 Chuang .
5,603,807 2/1997 Heinzmann .

FOREIGN PATENT DOCUMENTS 4239644 6/1994 (DE) .
19510009 9/1996 (DE) .
19621258 10/1997 (DE) .
19715789 10/1998 (DE) .
19715790 10/1998 (DE) .
19747295 1/1999 (DE) .
774540 5/1997 (EP) .
815320 6/1999 (EP) .

OTHER PUBLICATIONS

Article by Schmidt–Rohr, Volker; "Betriebserfahrungen mit dem Roll–Gap–Former (Duoformer CFD) bei grafischen Papieren", *Wochenblatt fur Papierfabrikation 11*, 1994, pp. 441–446.

*Primary Examiner*—Stanley S. Silverman
*Assistant Examiner*—Mark Halpern
(74) *Attorney, Agent, or Firm*—Greenblum & Bernstein, P.L.C.

(57) ABSTRACT

A process and apparatus for controlling a breaking length ratio L/Q of a web. The process includes providing a fluid fiber layer using a headbox havng a headbox nozzle, producing a web from the fluid fiber layer, measuring a current breaking length ratio $L/Q_{CURR}$ of the web, comparing the current breaking length ratio $L/Q_{CURR}$ with a preset breaking length ratio $L/Q_{SET}$, determining a deviation between $L/Q_{CURR}$ and $L/Q_{SET}$, and adjusting a microturbulence in a vicinity of said headbox nozzle to change the deviation. The apparatus includes a machine having a headbox, the headbox has at least one headbox nozzle, at least one mechanism is used for influencing a microturbulence of a stock suspension flowing out of the headbox nozzle, at least one measuring device is used for measuring a current breaking length ratio $L/Q_{CURR}$ of the web, and a regulating device for changing the microturbulence, wherein the microturbulence is adjusted to change the $L/Q_{CURR}$.

30 Claims, 5 Drawing Sheets

PROCESS FOR REGULATING THE BREAKING LENGTH RATIO OF A MANUFACTURED PAPER WEB

CROSS-REFERENCE TO RELATED APPLICATIONS

The present application claims priority under 35 U.S.C. § 119 of German Patent Application No. 199 08 973.6, filed on Mar. 2, 1999, the disclosure of which is expressly incorporated by reference herein in its entirety.

BACKGROUND OF THE INVENTION

1. Field of The Invention

The invention relates to a process for regulating the breaking length ratio of a manufactured paper web by altering the microtuibulence in the vicinity of the headbox nozzle. The invention further relates to a paper machine with a headbox suitable for performing the process according to the invention.

2. Discussion of Background Information

Together with other quality-related parameters, the breaking length ratio of a paper web represents an important criterion in defining the properties and quality of manufactured paper. The breaking length ratio L/Q is defined as the ratio of the breaking length L in the longitudinal direction to the breaking length Q in the transverse direction of a paper web. The breaking length provides a measure of the tensile strength of the paper. The breaking length specifies how long a strip of paper can be before it tears under the load of its own weight. The breaking length ratio L/Q is obtained as a dimensionless number by measuring the breaking length in both the longitudinal and transverse directions and then taking the ratio of the two.

Different paper requirements place different demands on the breaking length ratio L/Q. This is especially true for papers processed m high-speed printing presses, for example, which require that the breaking length in the longitudinal direction L, be correspondingly higher, in order to ensure trouble-free operation of the printing press. In such a case, a high breaking length ratio, which also corresponds to a high Concora value, is required.

It is noted here, that according to the used finish and the production process on the paper machine, the total breaking length potential is limited. This fact is given more or less by the geometric mean (GM) value of the breaking length $GM=(L/Q)^{1/2}$. Therefore, increasing L/Q means increasing L as well as reducing Q at the same time. Reducing L/Q means reducing L and increasing Q.

Some papers require a high uniform tensile strength in both the longitudinal and transverse directions. For example, these may include format papers and many packaging papers. In this case, the breaking length ratio L/Q should be as close to 1 as possible, i.e., L and Q should each approximate the same value. This means that the tensile strength of the paper is essentially uniform in all directions.

Other papers have different requirements. A further example is provided by the fact that there is no uniform evaluation of the center layer of corrugated board, referred to as flute or fluting. Some customers evaluate flute with the Concora Medium Test (CMT), for which a relatively high breaking length ratio is needed. At the same time, the Short Compression Test transverse to the web ($SCT_{TRANS}$), for which the lowest possible breaking length ratio L/Q is needed (reducing the CMT value), is also commonly used for evaluation, This means that the manufacturers of flute are forced to alternately produce flute with high and low breaking length ratios when supplying to different customers.

The prior art discloses a process for influencing the breaking length cross profile of a moving fiber web. Such a process is described in European patent application EP 0 774 540 A2. The object of this invention is to bring uniformity to the cross profile of the breaking lengths of a paper web, which profile varies across the web width and has values at the edges in particular that deviate from the average.

However, this reference does not specify a process for adjusting and regulating of a paper machine in a manner disclosed by the instant invention. It merely suggests the possibility of exercising influence on the cross direction breaking length profile of the paper web in the edge zones.

Thus, the prior art does not address or solve the problem of how a specific breaking length ratio L/Q, corresponding to customer requirements, can be controlled in the manufacturing of paper, and especially doing so in an ongoing manufacturing operation.

SUMMARY OF THE INVENTION

The invention provides a process and apparatus for adjusting and regulating the breaking length ratio L/Q of a paper web while it is being produced, such that it allows for the breaking length ratio L/Q to be adapted to customer specifications and maintained during the production process.

The invention provides that the process for adjusting and regulating the 20 breaking length ratio L/Q of a manufactured paper web, includes the following process steps; producing a fluid fiber layer with the aid of a headbox having a headbox nozzle, producing a paper web from the fluid fiber layer, measuring the current breaking length ratio $L/Q_{CURR}$ of the paper web at the running web, comparing the current breaking length ratio $L/Q_{CURR}$ with a preset breaking length ratio $L/Q_{SET}$ and determining the deviation from a setpoint, raising the microturbulence in the vicinity of the headbox nozzle if the current breaking length ratio $L/Q_{CURR}$ is greater Man the preset breaking length ratio $L/Q_{SET}$, and lowering the microturbulence in the vicinity of the headbox nozzle if the current breaking length ratio $L/Q_{CURR}$ is less than the preset breaking length ratio $L/Q_{SET}$.

According to the invention, it is possible to predetermine a specific breaking length ratio L/Q for a paper web, measure the current value during the manufacturing process, and alter and adjust the microturbulence in the vicinity of the headbox nozzle such that the paper attains the desired breaking length ratio L/Q and the breaking length ratio remains constant Ping the production process.

Since microturbulence has a major influence on the orientation of the fibers in the paper web, and this orientation of the fibers plays an important part in determining the breaking length ratio, changing the microturbulence in the correct direction can be used to change the breaking length ratio as well and regulate it during production.

The microturbulence in the vicinity of the headbox nozzle can be changed in a variety of ways; for example, additional turbulence generators can be placed in the vicinity of the headbox nozzle, or jets of air or fluid can be applied, or other similar measures can be uses However, one preferred way is for the headbox to be equipped with at least one movable separating lamella and for the change in microturbulence to be accomplished by moving the separating lamella in the machine direction. Moving the separating lamella changes the cross-section in the exit region of the headbox and thus changes the wall effects in the flow which, in turn, generates the microturbulence.

In addition, it is advantageous to measure the breaking length ratio $L/Q_{CURR}$ with the aid of ultrasonic measurement. This ultrasonic measurement makes it possible to determine the breaking length ratio in real time and on-line during operation. Such a mechanism allows for easily regulating the breaking length ratio.

However, other conventional measurement devices may be also be used, For example; spectroscopic measurement as disclosed in DE 195 10 009 A1, which is expressly incorporated by reference, may be used in place of ultrasonic measurement, The determination of the breaking length ratio L/Q in the paper machine is preferably performed using the ultrasonic method. In this method, an ultrasonic transmitter is placed at anyone of a number of measurement points. Additionally, at least two acoustic receivers are positioned at a specific distance, at least one in the longitudinal and at least one in the transverse directions of the web. Both transmitters and receivers are placed in contact with or in the immediate vicinity of the paper web. At regular intervals, the paper web is set into oscillation by the measurement transmitter using short ultrasonic pulses. The time between the transmission and reception of the pulse by the two receives in the longitudinal and transverse directions is measured simultaneously, and the sound velocities vL and vQ of the pulse in the longitudinal and transverse directions of the paper web are measured. It is furthermore within the purview of an ordinarily skilled artisan to establish acceptable settings for adequately measuring the breaking length ratio L/Q. And if other measurement techniques are used to make this measurement, any settings required to make this measurement, would similarly be within the ordinary skill level of an artisan.

The determination of the breaking length ratio L/Q from $v_L$ and $v_Q$ is based on the fact that there is a very good correlation between the stiffness of the paper web (relationship between extension length of a paper strip as a result of a specific tensile force) and its breaking length. Stiffness can be calculated from the specific sound velocity on the basis of physical laws. Thus, a usable approximation for the breaking length ratio is obtained by squaring the fraction of $v_L$ and $v_Q$, as follows:

$$L/Q \cong (v_L/v_Q)V_Q)^2.$$

The accuracy of the above formula will be sufficient in many cases to regulate L/Q in a running paper machine. However, when required, a relationship that is more precise may be used by expanding/modifying the formula such that the stiffness and breaking length of the paper are measured in the laboratory and appropriate comparisons are performed between the two values.

In performing the regulation process, it is additionally advantageous for the magnitude of the change in the microturbulence to be proportional to the absolute difference between the current breaking length ratio $L/Q_{CURR}$ and the preset breaking length ratio $L/Q_{SET}$. Additionally, it may be advantageous to use more complex relationships (other than linear ones) between the difference ($L/Q_{CURR}$ $-L/Q_{SET}$) and the correction value of the microturbulence level.

Moreover, the microturbulence would be increased when the breaking length ratio L/Q is too high and decreased when the breaking length ratio L/Q is too low.

If the headbox is equipped with a separating lamella, then this separating lamella may be moved opposite to the machine direction when the breaking length ratio L/Q is too low, and moved in the machine direction when the breaking length ratio L/Q is too high. Moving the lamella in the machine direction decreases the cross-section in the exit region of the headbox, resulting in increased microturbulence, and vice versa.

A further embodiment of the process according to the invention provides for the breaking length ratio $L/Q_{CURR}$ to be measured as a cross profile across the machine width and for the microturbulence to be changed/regulated by sections across the machine width. Here it can be advantageous to perform the cross direction profile measurement by means of a plurality of measurement points distributed across the machine width. Alternatively, the cross direction profile measurement can also be accomplished by at least one measurement point that is arranged so as to be movable in the transverse direction of the machine to take measurements across the web, Measuring the cross-profile with a plurality of measuring points across the width of the web can be accomplished by using a relatively high number of sensors for the measurement points and this would provide good coverage of the cross direction profile. This may be advantageous since each measurement point provides a continuous longitudinal profile for its section.

Measuring the cross-profile across the width of the web can also be accomplished using at least one moveable measuring point or sensor. This sensor may be moved in the transverse direction of the machine during operation, even though measurement values exist at every point across the width of the paper web, they occur at different points in time so that the measured cross direction profile does not represent an actual cross direction profile, but rather an oblique profile of the paper web.

The invention also contemplates adjusting the speed difference between the free jet emerging from the nozzle and the screen simultaneously with influencing the microturbulence in the vicinity of the headbox nozzle.

The invention also contemplates an apparatus which includes a paper machine having a headbox with at least one headbox nozzle for forming a fluid fiber layer and at least one mechanism for influencing the microturbulence of the stock suspension flowing out of the headbox nozzle. The apparatus can measure the breaking length ratio $L/Q_{CURR}$ of the paper web at the running web and compare the current breaking length ratio $L/Q_{CURR}$ to a preset ratio $L/Q_{SET}$. It can also determine the deviation, and regulate/control the intensity of the microturbulence in the vicinity of the headbox nozzle as a function of the breaking length ratio L/Q of the paper web being produced The microturbulence is increased if the current breaking length ratio $L/Q_{CURR}$ is greater than the preset breaking length ratio $L/Q_{SET}$, or reduced if the current breaking length ratio $L/Q_{CURR}$ is less than the preset breaking length ratio $L/Q_{SET}$.

Another embodiment provides at least one mechanism for influencing microturbulence to be at least one movable separating lamella within the headbox. It can measure the breaking length ratio $L/Q_{CURR}$ of the paper web using an ultrasonic measuring device. It is noted that similar adjustment devices for the movable separating lamellas, are described in published Patent Application DE 197 15 789 A1 as an example. Another adjustment device is shown in FIG. 1, which will be explained later.

The invention also contemplates the use of processor and suitable program for comparing the current breaking length ratio $L/Q_{CURR}$ to a preset breaking length ratio $L/Q_{SET}$ and/or for determining the deviation. The regulation/control of the intensity of the microturbulence in the vicinity of the headbox nozzle is set as a finction of the breaking length ratio L/Q of the paper web being produced. This aspect may also be subject to control by a processor with a computer program whose algorithm achieves at least one of the process variables described herein. Moreover, this algorithm may be either a linear algorithm or a non-linear higher order algorithm. Further, one can select any number of algorithms or empirically determine one based upon specific measurements taken with respect to the breaking length ratio and based upon the microturbulence settings.

Furthermore, it is advantageous for a plurality of measurement points for the breaking length ratio L/Q to be distributed across the width of the machine, or alternatively for at least one measurement point for the breaking length ratio L/Q to be arranged so as to be movable in the transverse direction of the machine. If the breaking length ratio is measured as a cross direction profile, the possibility exists of also sectionally influencing the microturbulence, and designing this influencing so that it can be adjustable by sections, in addition to influencing the breaking length ratio across the entire width of the machine. This measure also provides the option of bringing uniformity to the cross direction profile of the breaking length ratio across the width of the machine.

It goes without saying that the aforementioned features of the invention, and those to be explained below, can be used not only in the individual combinations described, but also in other combinations or alone without departing from the scope of he invention.

According to one aspect of the invention there is provided a process for regulating a breaking length ratio L/Q of a manufactured paper web which includes providing a fluid fiber layer using a headbox having a headbox nozzle, producing a paper web from the fluid fiber layer, measuring a current breaking length ratio $L/Q_{CURR}$ of the paper web, comparing the current breaking length ratio $L/Q_{CURR}$ with a preset breaking length ratio $L/Q_{SET}$ determining a deviation between $L/Q_{CURR}$ and $L/Q_{SET}$ and changing a microturbulence based upon said deviation. The microturbulence is raised in a vicinity of the headbox nozzle if the current breaking length ratio $L/Q_{CURR}$ is greater than the preset breaking length ratio $L/Q_{SED}$ and reduced in the vicinity of the headbox nozzle if the current breaking length ratio $L/Q_{CURR}$ is less tan the preset breaking length ratio $L/Q_{SET}$.

The process may also provide for changing said microtubulence by moving at least one movable separating lamella located in the headbox. Additionally, determining the breaking length ratio L/Q may be performed by ultrasonic measurement. The microturbulence may be changed in a manner which is proportional to the absolute difference between the current breaking length ratio $L/Q_{CURR}$ and the preset breaking length ratio $L/Q_{SET}$. Moreover, the process may include identifying a desired specific breaking length ratio $L/Q_{SET}$ value, and reducing the microturbulence when the breaking length ratio $L/Q_{CURR}$ is too low with respect to the specific breaking length ratio $L/Q_{SET}$ value. Attentively, the process may include identifying a desired specific breaking length ratio $L/Q_{SET}$ value, and increasing the microturbulence when the breaking length ratio $L/Q_{CURR}$ is too high with respect to the specific breaking length ratio $L/Q_{SET}$ value.

The invention may also include identifying a desired specific breaking length ratio L/Q value, providing a moveable separating lamella within the headbox, wherein the movement is defined by movement in at least a machine direction and a direction opposite the machine direction, and moving the separating lamella in the machine direction when the breaking length ratio L/Q is too high with respect to the specific breaking length ratio L/Q value. Attentively, the process may provide for identifying a desired specific breaking length ratio L/Q value, providing a moveable separating lamella within the headbox, wherein the movement is defined by movement in at least a machine direction and a direction opposite the machine direction, and moving the separating lamella in the opposite direction when the breaking length ratio L/Q is too low with respect to the specific breaking length ratio LQ value.

The process may include measuring the breaking length ratio L/Q in a cross direction profile, and changing the microturbulence in sections across a machine width. The cross direction profile measurement may be accomplished by a plurality of measurement points, wherein the plurality of measurement points are distributed across the width of the machine. Alternatively, the cross direction profile measurement is accomplished by at least one moveable measurement point. The at least one moveable measurement point may be movable in a transverse direction of said machine.

The process may further include adjusting a speed difference between a moving screen and a free jet emerging from the headbox nozzle, and simultaneously influencing the microturbulence in a vicinity of the headbox nozzle.

The invention also provides for an apparatus for regulating a breaking length ratio L/Q of a manufactured paper web which includes a paper machine having a headbox, wherein the headbox has at least one headbox nozzle for forming a fluid fiber layer and at least one mechanism for influencing a microturbulence of a stock suspension flowing out of the headbox nozzle, a measuring device for measuring a current breaking length ratio $L/Q_{CURR}$ of the paper web, a comparing device for comparing the current breaking length ratio $L/Q_{CURR}$ to a preset ratio $L/Q_{SET}$, the comparing device determining a deviation, a adjusting device for affecting an intensity of the microturbulence in a vicinity of the headbox nozzle. The microturbulence is affected as a function of the breaking length ratio L/Q of the paper web being produced.

The apparatus may provide that the microturbulence is increased in the vicinity of said headbox nozzle if the current breaking length ratio $L/Q_{CURR}$ is greater than a preset breaking length ratio $L/Q_{SET}$ Alternatively, the microturbulence in the vicinity of said headbox nozzle is reduced if said current breaking length ratio $L/Q_{CURR}$ is less than said preset breaking length ratio $L/Q_{SET}$. The at least one mechanism may be a movable separating lamella. The measuring device may be an ultrasonic measuring device. The comparing device may be a processor and a computer program. The regulation device may be a processor and a computer program utilizing an algorithm. Moreover, the measuring device may be a plurality of measurement points located across a width of the paper machine. Alternatively, the measuring device may be at least one measurement point arranged so as to be movable in a transverse direction of the paper machine. The mechanism may include a plurality of sectional devices for sectionally influencing the microturbulence in a transverse direction of the paper machine.

The invention also provides for a process for controlling a breaking length ratio L/Q of a web which includes providing a fluid fiber layer using a headbox having a headbox nozzle, producing a web from the fluid fiber layer, measuring a current breaking length ratio $L/Q_{CURR}$ of the web, comparing the current breaking length ratio $L/Q_{CURR}$ with a preset breaking length ratio $L/Q_{SET}$, determining a deviation between $L/Q_{CURR}$ and $L/Q_{SET}$ and adjusting a microturbulence in a vicinity of the headbox nozzle to change the deviation, The process may include adjusting the microturbulence by moving at least one movable separating lamella located in the headbox. The determining of the breaking length ratio L/Q may be performed with ultrasonic measurement, The adjusting of the microturbulence may be accomplished in a manner which is proportional to an absolute difference between the current breaking length ratio $L/Q_{CURR}$ and the preset breaking length ratio $L/Q_{SET}$.

The process may include identifying a desired specific breaking length ratio L/Q value, wherein the adjusting comprises reducing the microturbulence when the breaking length ratio L/Q is too low with respect to the specific breaking length ratio L/Q value. Alternatively, the process may provide for identifying a desired specific breaking length ratio L/Q value, wherein the adjusting comprises increasing the microturbulence when the breaking length ratio L/Q is too high with respect to the specific breaking length ratio L/Q value. The process may include identifying a desired specific breaking length ratio L/Q value, providing a moveable separating lamella within the headbox, wherein the movement is defined by movement in at least a machine direction and a direction opposite the machine direction, and moving the separating lamella in the machine direction when the breaking length ratio L/Q is too high with respect to the specific breaking length ratio L/Q value. Alternatively, the process may provide for identifying a desired specific breaking length ratio L/Q values providing a moveable separating lamella within the headbox, wherein the movement is defined by movement in at least a machine direction and a direction opposite the machine direction, and moving the separating lamella in the opposite direction when the breaking length ratio L/Q is too low with respect to the specific breaking length ratio L/Q value, The process may further include measuring the breaking length ratio L/Q in a cross direction profile, and changing the microturbulence in sections across a machine width. The measuring may include a plurality of measurement points, wherein the plurality of measurement points are distributed across said machine width. Alternatively, the measuring may include at least one measurement point, wherein the at least one measurement point is movable in a transverse direction of the machine. The process may provide for forming a web on a moving screen. The speed of the moving screen may be adjusted, The process may additionally provide for adjusting a speed of a free jet emerging from the headbox nozzle, and simultaneously adjusting the microturbulence in a vicinity of the headbox nozzle.

The invention also provides for an apparatus for controlling a breaking length ratio L/Q of a web which includes a machine comprising a headbox, the headbox having at least one headbox nozzle, at least one mechanism for influencing a microturbulence of a stock suspension flowing out of the headbox nozzle, at least one measuring device for measuring a current breaking length ratio $L/Q_{CURR}$ of the web, a regulating device for changing the microturbulence. The microturbulence is adjusted to change said $L/Q_{CURR}$. The regulating device may include at least one comparing device for comparing the current breaking length ratio $L/Q_{CURR}$ to a preset ratio $L/Q_{SET}$ the comparing device determining a deviation. The regulating device may change the microturbulence to substantially eliminate the deviation. The at least one comparing device may be a processor and a computer program.

The apparatus may further provide that the regulating device changes the microturbulence as a function of the breaking length ratio L/Q of the web being produced, such that the microturbulence is increased if the current breaking length ratio $L/Q_{CURR}$ is greater than a preset breaking length ratio $L/Q_{SET}$. Alternatively, the apparatus may provide that the regulating device changes the microturbulence as a function of the breaking length ratio L/Q of the web being produced, such that the microturbulence is reduced if the current breaking length ratio $L/Q_{CURR}$ is less than the preset breaking length ratio $L/Q_{SET}$.

The apparatus may have at least one mechanism which influences the microturbulence in a vicinity of the headbox nozzle. The at least one mechanism may be a movable separating lamella. The at least one measuring device may be an ultrasonic measuring device. The regulating device may be a processor and a computer program utilizing an algorithm. The at least one measuring device may be a plurality of measurement devices located across a width of the machine. Alternatively, the at least one measuring device may be movable with respect to the web. The at least one measuring device may also be movable in a transverse direction of the machine. Moreover, the at least one mechanism may include a plurality of sectional devices for sectionally influencing the microturbulence in a transverse direction of the machine.

The invention also provides for a process for controlling a breaking length ratio L/Q of a web which includes providing a fluid fiber layer using a headbox having a headbox nozzle, producing a web on a screen from the fluid fiber layer, ultrasonically measuring a current breaking length ratio $L/Q_{CURR}$ of the web, electronically comparing the current breaking length ratio $L/Q_{CURR}$ with a preset breaking length ratio $L/Q_{SET}$, electronically determining a deviation between $L/Q_{CURR}$ and $L/Q_{SET}$, and electromechanically adjusting a microturbulence in a vicinity of the headbox nozzle to change the deviation.

The invention also provides for an apparatus for controlling a breaking length ratio L/Q of a web which includes a machine comprising a headbox, the headbox having at least one headbox nozzle, at least one mechanism for influencing a microturbulence of a stock suspension flowing out of the headbox nozzle, at least one ultrasonic measuring device for measuring a current breaking length ratio $L/Q_{CURR}$ of the web, an electronic regulating device in the form of a computer processor and a computer program for electromechanically changing the microturbulence, wherein the microturbulence is adjusted by the at least one mechanism in response to the electronic regulating device so as to change the $L/Q_{CURR}$.

Additional features and advantages of the invention are clear from the following description of preferred exemplary embodiments with reference to the drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

The invention shall be described in greater detail below with reference to the drawings.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1A:
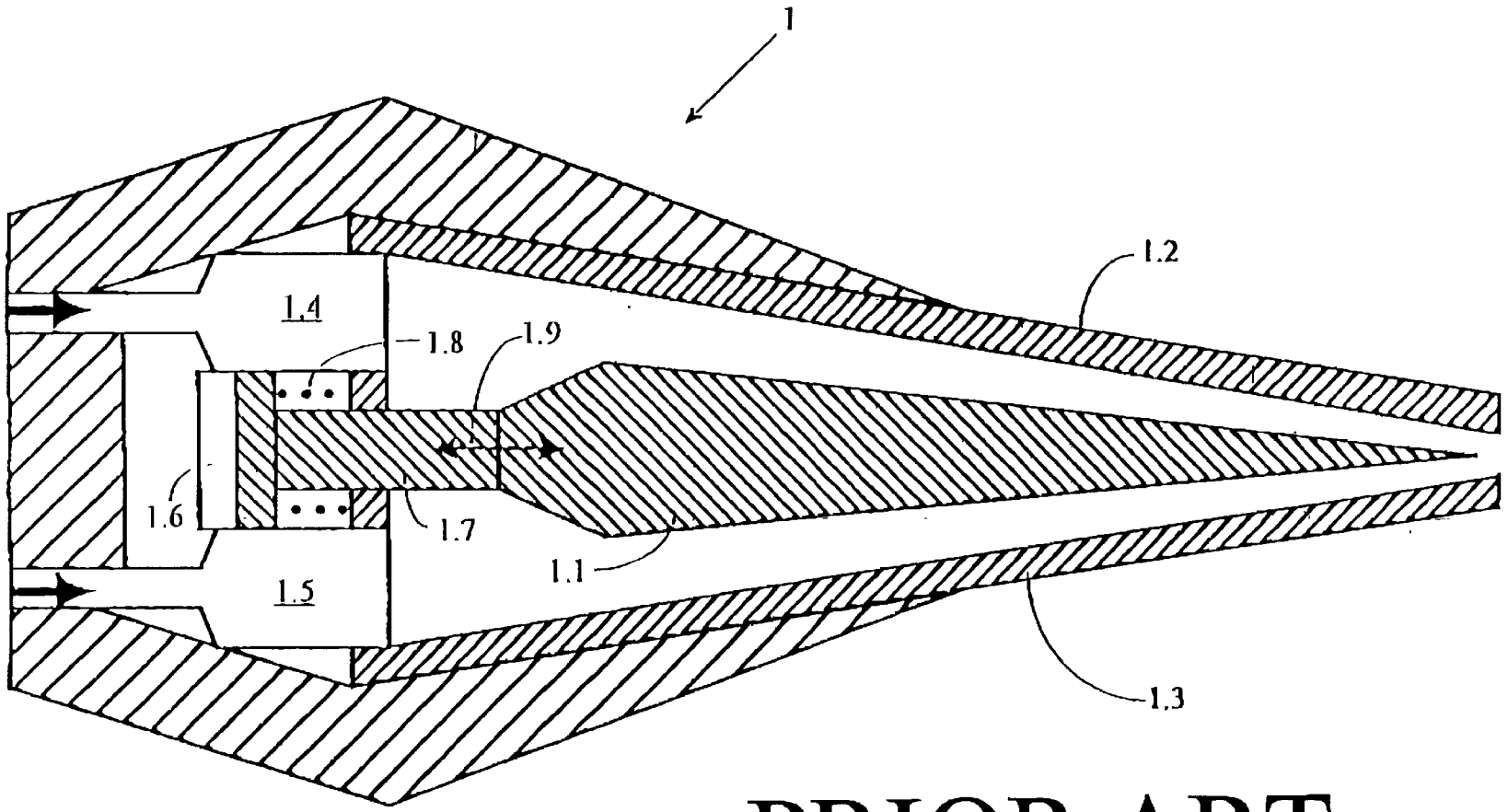
PRIOR ART Fig. 1A
FIG. 1A shows a cross-section of a conventional headbox with movable separating lamella.
Figure 1B:
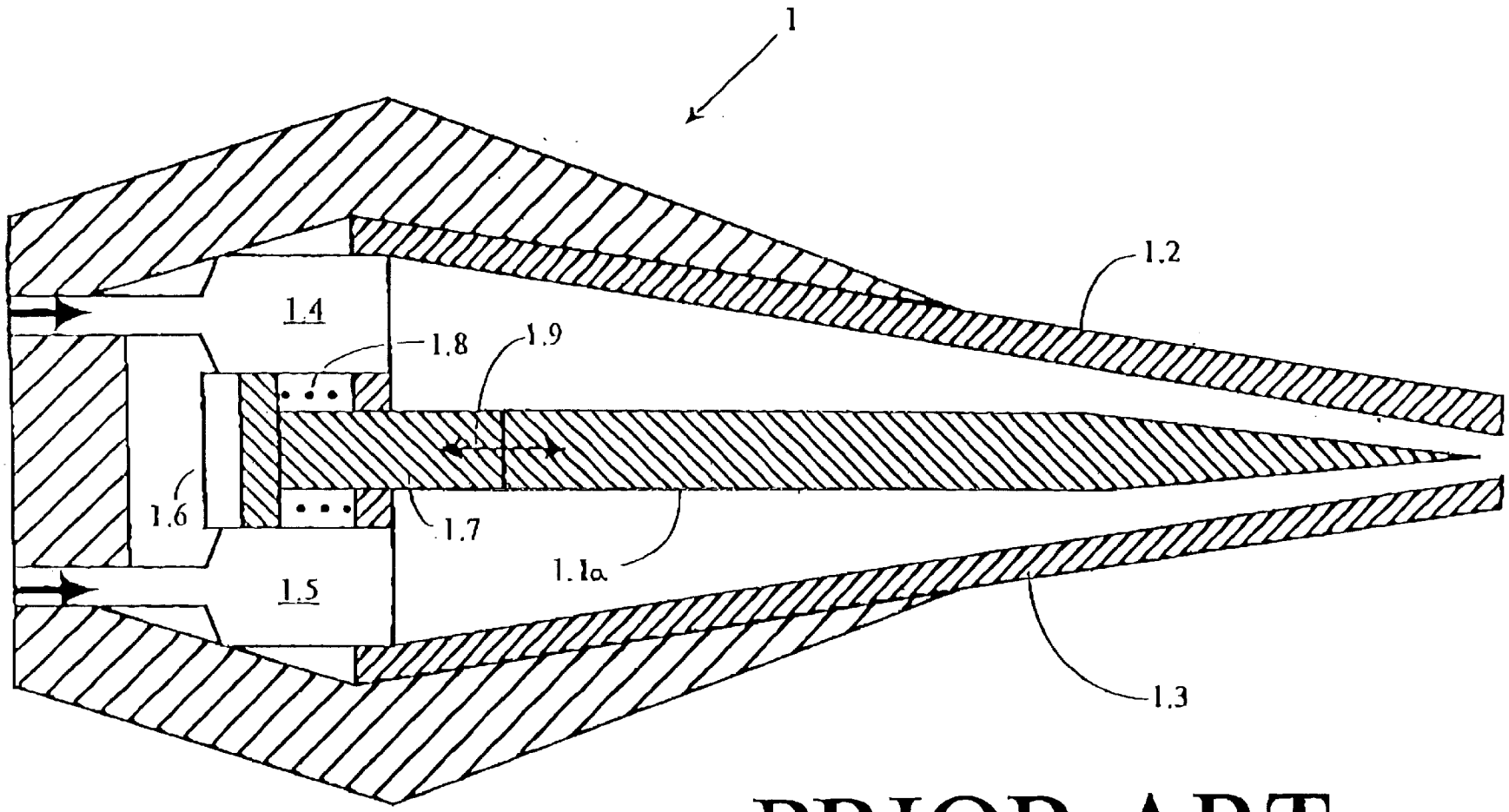
PRIOR ART Fig. 1B
FIG. 1B shows a cross-section of another conventional headbox with movable separating lamella.

FIG. 1 shows a conventional C-clamp style headbox 1 with a movable separating lamella 1.1. The headbox nozzle, which is formed by nozzle upper wall 1.2 and nozzle lower wall 1.3, is supplied with stock suspension by two rows of turbulence conduits 1.4 and 1.5. Located in this headbox nozzle is separating lamella 1.1 which is arranged so as to be movable in the lengthwise direction Movement of separating lamella 1.1 is achieved by pressurizing pressure chamber 1.6 with a pressure medium, which acts on a biasing device, here designated as spring 1.8, arranged on the opposite side, and can thereby move transition piece 1.7 with separating lamella 1, in the machine direction as desired (movement towards nozzle exit on right side of drawing). Separating lamella 1.1 has a cross-section which is convergent in the direction of flow. Additionally, other types of lamellas may be used which have only a convergent part, for example, at the tip. In this case, the first part may utilize a constant cross-section (see FIG. 1B)

In the region of the headbox nozzle exit, a narrowing of the exit conduit is achieved by moving separating lamella 1.1 in the machine direction, which causes increased microturbulence to be generated. Conversely, moving separating lamella 1.1 in the direction opposite the machine direction brings about an enlargement of the exit conduit, which causes a reduction in the flow speed of the stock suspension flowing through and thus a reduction in the microturbulence, to take place.

Figure 2:
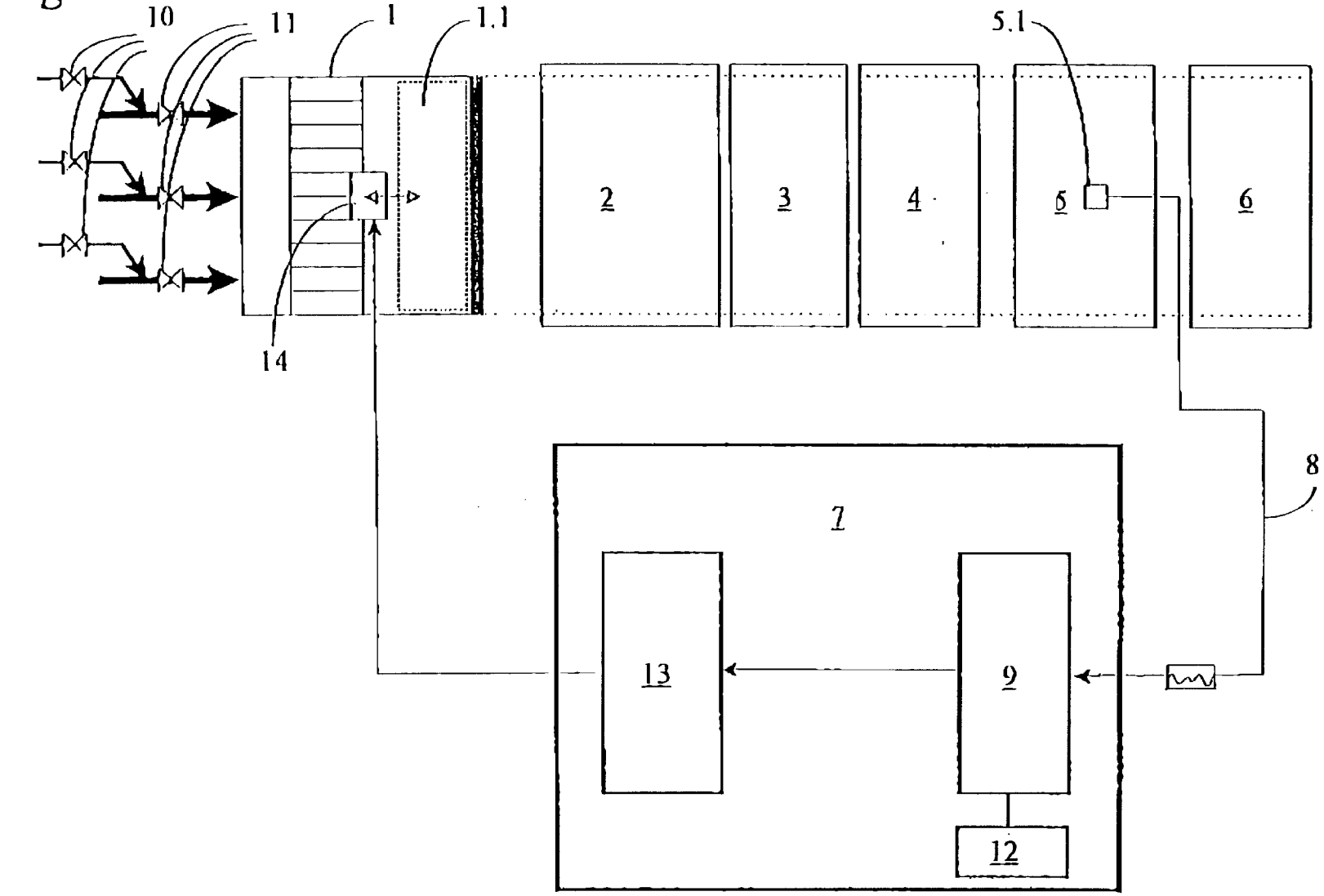
FIG. 2 shows a schematic representation of a paper machine with regulating device and headbox with one-piece separating lamella.

FIG. 2 shows a paper machine having a headbox 1 which corresponds to the device shown in FIG. 1. The headbox 1 is supplied in sections with flows of stock suspension which can be controlled or regulated on a section-by-section basis by control valves 10 and 11.

Headbox 1 generates a fluid fiber layer which is applied to either one screen or two screens running in a sandwich-like manner. The web is dewatered in screen section 2. This is followed by pressing the material web in press section 3, drying the material web in dryer section 4, and rolling up the paper web in winding device 6.

Located between dryer section 4 and winding device 6 is a measuring frame which has a measurement point 5.1. Measuring point 5.1 measures the breaking length ratio of the paper web at this point, using an ultrasonic sensor, for example, and transmits this information over a data line 8 to a regulating device 7.

Regulating device 7 utilizes a program module 9, for example, which compares the measured breaking length ratio $L/Q_{CURR}$ to a preset breaking length ratio $L/Q_{SET}$, which is stored in, memory 12. According to the difference between the preset breaking length ratio and the current measured breaking length ratio, a command is transmitted to a control device 13, which operates an actuator 14, which performs an adjustment of the separating lamellas 1.1 in the headbox 1 and a corresponding adjustment of the microturbulence.

After adjusting the separating lamellas 1.1, provision is made for some delay until the effects of the adjustment on the paper web arrive at the measurement point 5.1. Then re-regulation takes place according to the newly measured breaking length ratio. Advantageously, the regulating mechanism can also be designed such that the size of the adjustment of the separating lamella 1.1 is oriented to the size of the deviation of the breaking length ratio from the desired breaking length ratio, or such that the size of the adjustment is directly proportional thereto.

Figure 3:
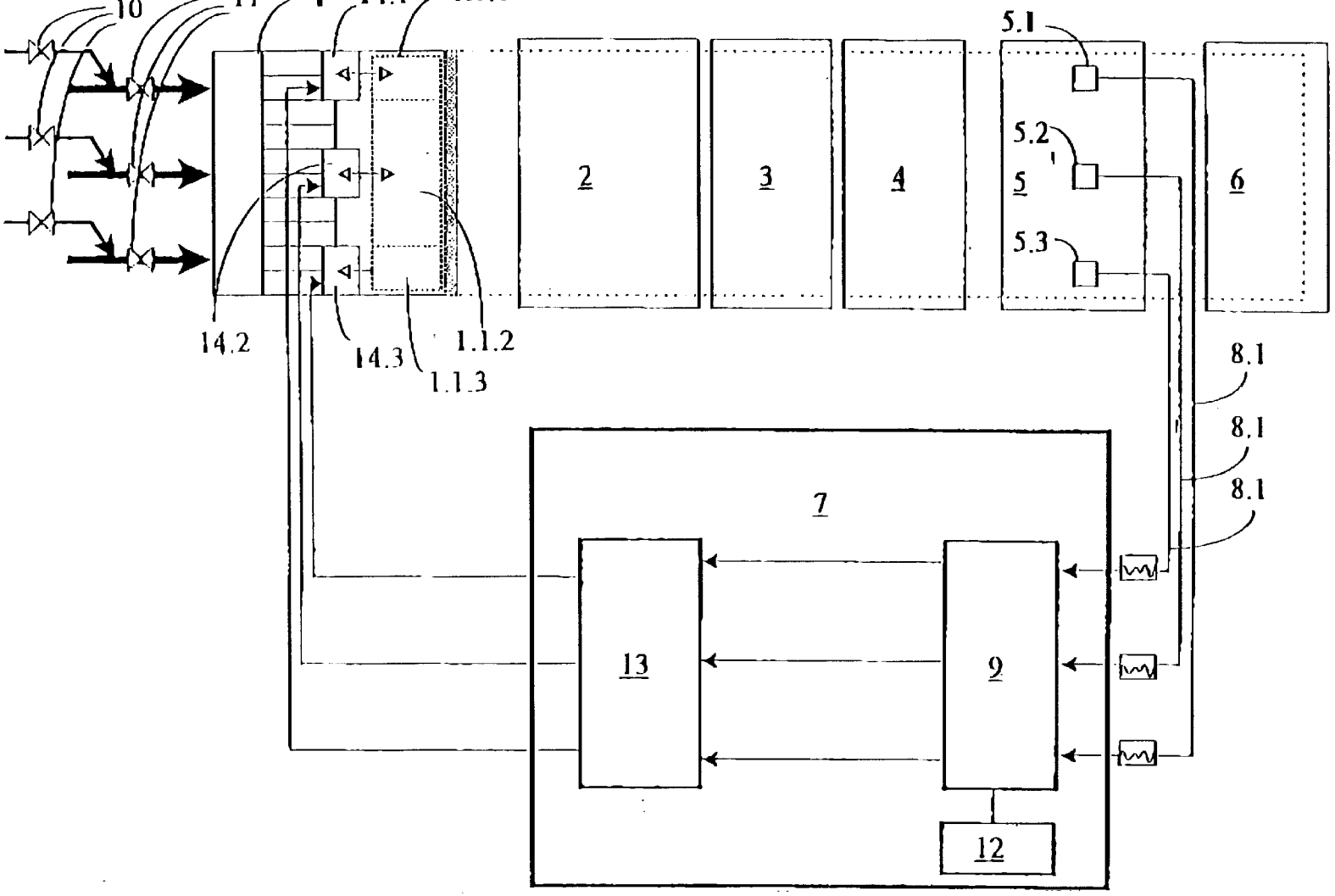
FIG. 3 shows a schematic representation of a paper machine with regulating device, divided separating lamella and several measurement points.
Figure 4:
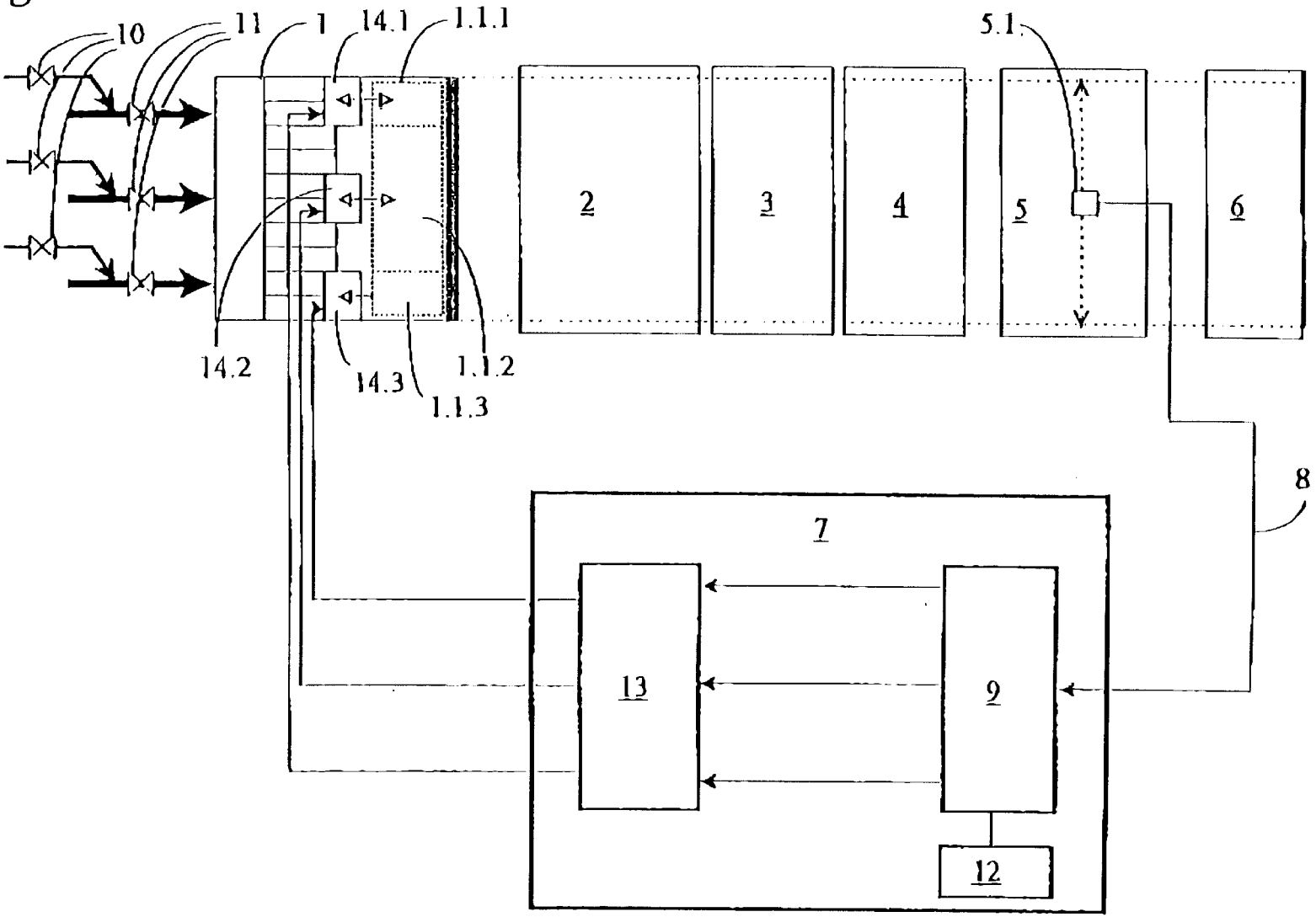
FIG. 4 shows a schematic representation of a paper machine with regulating device, divided separating lamella and one traversing measurement point.

FIG. 3 shows another embodiment of a paper machine similar to that in FIG. 2, except that the separating lamella of the headbox 1 is divided into several sections 1.1.1–1.1.3. A corresponding number of measurement points 5.1 to 5.3 are likewise provided in measuring frame 5. The regulating mechanism corresponds in principle to the regulating mechanism described for FIG. 2, except that here, each segment of the lamella 1.1 to 1.3 is also associated with each individual measuring point 5,1 to 5.3. These lamella segments are regulated by sections, and actuators 14.1–14.3 for adjustment of the segments are each controlled separately. This embodiment provides the option of specifically influencing particularly undesirable edge effects, so that it is possible to bring uniformity to the breaking length ratio across the width of the machine, Finally, FIG. 4 shows another embodiment of a paper machine. This embodiment uses sectional separating lamellas in the headbox 1, similar to FIG. 3. However, in this embodiment, a single sensor with one measurement point 5.1 is present for measuring the breaking length ratio $L/Q_{CURR}$ across the paper web. The measurement point 5.1 is designed to be movable across the machine width and the width of the web during operation. It functions by measuring a cross machine profile of the breaking length ratio of the paper web. This profile is transmitted to regulating device 7, enabling a specific, section-by-section adjustment of the separating lamella segments 1.1.1 to 1.1.3. Thus, with the use of a single sensor, it is not only possible to adjust the breaking length ratio of the paper web along the longitudinal profile, but also to adapt the cross machine profile of the breaking length ratio of the paper web to the desired preset value, It is also possible to determine the average value of the breaking length ratio across the entire width of the machine, for example, by means of a movable sensor as shown in FIG. 4. This average value can be used as the breaking length ratio $L/Q_{CURR}$ for regulating the adjustment of a separating lamella 1.1 that runs the width of the machine.

It is noted that the foregoing examples have been provided merely for the purpose of explanation and are in no way to be construed as limiting of the present invention. While the present invention has been described with reference to an exemplar embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

1 headbox
1.1, 1.1*a* separating lamella
1.1.1–1.1.3 separating lamella segments
1.2 upper wall
1.3 lower wall
1.4, 1.5 turbulence conduit
1.6 pressure chamber
1.7 transition piece with piston
18 spring
1.9 movement direction of the separating element
2 screen section
3 press section
4 dryer section
5 measuring frame
5.1–5.3 measuring point with sensor
6 winding device
7 regulating device
8 data line
9 program module
10 control valve
11 control valve
12 memory
13 control device
14, 14.1–14.3 actuator

What is claimed is:

1. A process for regulating a breaking length ratio L/Q of a manufactured paper web comprising:

providing a fluid fiber layer using a headbox having a headbox nozzle;

producing a paper web from said fluid fiber layer;

measuring a current breaking length ratio $L/Q_{CURR}$ of said paper web;

comparing said current breaking length ratio $L/Q_{CURR}$ with a preset breaking length ratio $L/Q_{SET}$;

determining a deviation between $L/Q_{CURR}$ and $L/Q_{SET}$; and changing a microturbulence based upon said deviation;

wherein said microturbulence is raised in a vicinity of said headbox nozzle if said current breaking length ratio $L/Q_{CURR}$ is greater than said preset breaking length ratio $L/Q_{SET}$, and wherein said microturbulence is reduced in said vicinity of said headbox nozzle if said current breaking length ratio $L/Q_{CURR}$ is less than said preset breaking length ratio $L/Q_{SET}$.

2. The process of claim 1, further comprising:

changing said microturbulence by moving at least one movable separating lamella located in said headbox.

3. The process of claim 1, wherein said determining said breaking length ratio L/Q is performed by ultrasonic measurement.

4. The process of claim 1, further comprising:

changing said microturbulence in a manner which is proportional to the absolute difference between said current breaking length ratio $L/Q_{CURR}$ and said preset breaking length ratio $L/Q_{SET}$.

5. The process of claim 1, farther comprising:

changing said microturbulence in a manner which includes a higher order than a linear relationship including the difference between $L/Q_{CURR}$ and $L/Q_{SET}$.

6. The process of claim 1, further comprising:

identifying a desired specific breaking length ratio $L/Q_{SET}$; and reducing said microturbulence when said current breaking length ratio $L/Q_{CURR}$ is lower than said specific breaking length ratio $L/Q_{SET}$.

7. The process of claim 1, further comprising:

identifying a desired specific breaking length ratio $L/Q_{SET}$; and increasing said microturbulence when said breaking length ratio $L/Q_{CURR}$ is higher than said specific breaking length ratio $L/Q_{SET}$.

8. The process of claim 1, further comprising, identifying a desired specific breaking length ratio $L/Q_{SET}$;

providing a moveable separating lamella within said headbox, said movement being defined by movement in at least a machine direction and a direction opposite said machine direction; and moving said separating lamella in said machine direction when said breaking length ratio $L/Q_{CURR}$ is too high with respect to said specific breaking length ratio $L/Q_{SET}$.

9. The process of claim 1, further comprising:

identifying a desired specific breaking length ratio $L/Q_{SET}$;

providing a moveable separating lamella within said headbox, said movement being defined by movement in at least a machine direction and a direction opposite said machine direction; and moving said separating lamella in said opposite direction when said breaking length ratio L/Q is too low with respect to said specific breaking length ratio L/Q value.

10. The process of claim 1, further comprising:

measuring said breaking length ratio L/Q in a cross direction profile; and changing said microturbulence in sections across a machine width.

11. The process of claim 10, wherein said cross direction profile measurement is accomplished by a plurality of measurement points, said plurality of measurement points being distributed across said width of said machine.

12. The process of claim 10, wherein said cross direction profile measurement is accomplished by at least one moveable measurement point.

13. The process of claim 12, wherein said at least one moveable measurement point is movable in a transverse direction of said machine.

14. The process of claim 1, further comprising:

adjusting a speed difference between a moving screen and a free jet emerging from said headbox nozzle; and simultaneously influencing said microturbulence in a vicinity of said headbox nozzle.

15. A process for controlling a breaking length ratio L/Q of a web comprising:

providing a fluid fiber layer using a headbox having a headbox nozzle;

producing a web from said fluid fiber layer;

measuring a current breaking length ratio $L/Q_{CURR}$ of said web;

comparing said current breaking length ratio $L/Q_{CURR}$ with a preset breaking length ratio $L/Q_{SET}$;

determining a deviation between $L/Q_{CURR}$ and $L/Q_{SET}$; and adjusting a microturbulence in a vicinity of said headbox nozzle to change said deviation.

16. The process of claim 15, further comprising:

adjusting said microturbulence by moving at least one movable separating lamella located in said headbox.

17. The process of claim 15, wherein said determining said breaking length ratio $L/Q_{CURR}$ is performed with ultrasonic measurement.

18. The process of claim 15, further comprising:

adjusting said microturbulerice in a manner using a linear control algorithm which is proportional to an absolute difference between said current breaking length ratio $L/Q_{CURR}$ and said preset breaking length ratio $L/Q_{SET}$.

19. The process of claim 15, further comprising:

adjusting said microturbulence in a manner using a non-linear higher order algorithm.

20. The process of claim 15, further comprising:

identifying a desired specific breaking length ratio $L/Q_{SET}$, wherein said adjusting comprises reducing said microturbulence when said breaking length ratio $L/Q_{CURR}$ is lower than said specific breaking length ratio $L/Q_{SET}$.

21. The process of claim 15, further comprising:

identifying a desired specific breaking length ratio $L/Q_{SET}$, wherein said adjusting comprises increasing said microturbulence when said breaking length ratio $L/Q_{CURR}$ is higher than said specific breaking length ratio $L/Q_{SET}$.

22. The process of claim 15, further comprising:

identifying a desired specific breaking length ratio $L/Q_{SET}$;

providing a moveable separating lamella within said headbox, said movement being defined by movement in at least a machine direction and a direction opposite said machine direction; and moving said separating lamella in said machine direction when said breaking length ratio $L/Q_{CURR}$ is too high with respect to said specific breaking length ratio.

23. The process of claim 15, further comprising:

identifying a desired specific breaking length ratio $L/Q_{SET}$;

providing a moveable separating lamella within said headbox, said movement being defined by movement in at least a machine direction and a direction opposite said machine direction; and moving said separating lamella in said opposite direction when said breaking length ratio L/QCURRis too low with respect to said specific breaking length ratio $L/Q_{SET}$.

24. The process of claim 15, further comprising:

measuring said breaking length ratio $L/Q_{CURR}$ in a cross direction profile; and changing said microturbulence in sections across a machine width.

25. The process of claim 24, wherein said measuring comprises a plurality of measurement points, said plurality of measurement points being distributed across said machine width.

26. The process of claim 24, wherein said measuring comprises at least one measurement point, said at least one measurement point being movable in a transverse direction of said machine.

27. The process of claim 15, wherein said producing comprises forming a web on a moving screen.

28. The process of claim 27, further comprising:

adjusting a speed of said moving screen.

29. The process of claim 28, further comprising:

adjusting a speed of a free jet emerging from said headbox nozzle; and simultaneously adjusting said microturbulence in a vicinity of said headbox nozzle.

30. A process for controlling a breaking length ratio L/Q of a web comprising:

providing a fluid fiber layer using a headbox having a headbox nozzle;

producing a web on a screen from said fluid fiber layer;

ultrasonically measuring a current breaking length ratio $L/Q_{CURR}$ of said web;

electronically comparing said current breaking length ratio $L/Q_{CURR}$ with a preset breaking length ratio $L/Q_{SET}$;

electronically determining a deviation between $L/Q_{CURR}$ and $L/Q_{SET}$; and electro-mechanically adjusting a microturbulence in a vicinity of said headbox nozzle to change said deviation.

* * * * *